US005451000A

United States Patent [19]

Shaw et al.

[11] Patent Number: 5,451,000

[45] Date of Patent: Sep. 19, 1995

[54] YARDAGE MARKER SYSTEM FOR SPRINKLERS

[75] Inventors: Gregory N. Shaw, Moreno Valley; John R. Skidgel, Solana Beach, both of Calif.

[73] Assignee: The Toro Company, Minneapolis, Minn.

[21] Appl. No.: 76,731

[22] Filed: Jun. 14, 1993

[51] Int. Cl.[6] ..... A63B 57/00

[52] U.S. Cl. ..... 239/71; 239/201; 273/32 H; 273/32 R; 40/622

[58] Field of Search ..... 239/71, 200, 201, 203, 239/204, 289; 273/34 R, 32 A, 32 H, 32 R, 176 L; 40/620, 622; 116/209, 222

[56] References Cited

U.S. PATENT DOCUMENTS

| | | | |
|---|---|---|---|
| 2,067,526 | 1/1937 | Graham | 40/622 |
| 2,568,513 | 9/1951 | Rossein | 40/622 |
| 4,014,118 | 3/1977 | Robinet et al. | 40/622 |
| 4,108,439 | 8/1978 | McGuire | 239/201 |
| 5,219,171 | 6/1993 | Kirby et al. | 273/32 H |
| 5,236,166 | 8/1993 | Darling | 273/32 R |

FOREIGN PATENT DOCUMENTS

| | | | |
|---|---|---|---|
| 2393380 | 2/1979 | France | 40/622 |
| 2202155 | 9/1988 | United Kingdom | 273/32 A |
| 2236206 | 3/1991 | United Kingdom | 40/622 |

OTHER PUBLICATIONS

Photograph illustrating Prior Art Yardage Marker. Date Unknown.

*Primary Examiner*—Karen B. Merritt
*Attorney, Agent, or Firm*—James W. Miller

[57] ABSTRACT

A yardage marker system for sprinklers includes a set of individual marker numbers that each have a single digit thereon selected from the range 0–9. A display area is provided on the top of the sprinkler, e.g. on the top of the pop-up riser portion of the sprinkler, for receiving and holding up to three marker numbers set side-by-side. Yardages from selected sprinklers to a point of reference, e.g. to some point on the green of the hole on which the sprinklers are installed, can be marked by applying selected ones of the marker numbers in the appropriate sequence to the display area on the sprinklers.

21 Claims, 2 Drawing Sheets

YARDAGE MARKER SYSTEM FOR SPRINKLERS

TECHNICAL FIELD

This invention relates to a yardage marker system for use on sprinklers installed on a golf course for indicating the distance in yards from the sprinkler to a point of interest, normally to some portion of the green of the hole on which the sprinkler is installed, and to a method of marking yardages on golf course sprinklers using this system.

BACKGROUND OF THE INVENTION

Yardage markers are often used on golf courses to indicate the distance, usually in yards, from the marker to some point on the green of the hole in question. Different golf courses may pick different points on the green to measure to. For example, some courses may indicate the distance from the marker to the center of the green, other courses might indicate the distance from the marker to the back edge of the green, while yet other courses might indicate the distance from the marker to the front edge of the green. However, most golfers playing a particular course will often know which point of the green the measurement is being made to. The purpose of the yardage markers is to give the golfer some idea of how far away he is from the green to aid in club and shot selection.

Yardage markers have been made in various ways. For example, some yardage markers include small stakes or posts which are placed along the fairway edges and which have the yardage value applied thereto. However, such markers can be placed only along the edges of the fairway and thus may not be easily visible to golfers in the middle of the fairway. In addition, such markers can be uprooted by vandals, requiring that they be reinstalled in the proper position. Moreover, the markers are exposed to the weather and are often made of wood or the like. This requires that the markers be periodically maintained by repainting them or the like.

Most golf courses these days are provided with underground irrigation systems. Such systems usually include many sprinklers spread out along the length of the course from the tee box to the green in at least the fairway portion of each hole. These sprinklers are placed not only along the sides of the fairways, but are often more or less easily distributed in the middle of the fairways as well. The sprinklers used in this application are pop-up sprinklers having a riser that retracts down into a housing buried in the ground but which elevates under the influence of water pressure applied thereto to irrigate the ground.

It has been previously realized that the tops of the golf course sprinklers could serve as convenient places to mark the yardage to the green. This has been done in the prior art by first measuring the distance from each sprinkler head to the reference point on the green and then having a plate made with the appropriate yardage figure painted or stamped thereon. This marker plate is then fixedly secured to the top of the sprinkler by gluing or screwing the plate to the sprinkler. This process is repeated for as many of the fairway sprinklers as is desired. Accordingly, while golfers are playing, they can locate the distance to the green by finding the nearest sprinkler and looking down to read the yardage figure provided on the marker plate.

The prior art marking system used on sprinklers has various disadvantages. It requires a survey of the yardage distances from each sprinkler to be made, for the yardage plates to then be custom made, and for the plates to be then applied at a later date after they are made to the right sprinklers in the right order. Thus, the yardage markers cannot be immediately applied to the sprinklers at the time of the survey but can be so applied only in a second trip. Moreover, the need to permanently affix the marker plate to the sprinkler involves some labor, particularly when the marker plate is screwed in place.

Another disadvantage presented by the prior art marking system is what happens if the yardage distances should change for some reason, e.g. the course is remodeled and the locations of the greens change. The sprinklers are now provided with incorrect marker plates. This requires that a whole new set of marker plates be made with the correct yardage distances, and that the new set of plates replace the old sets. In can be difficult to remove and replace the old set of plates without damaging some of the sprinklers. These damaged sprinklers must also be replaced. Accordingly, the prior art marking system is not capable of easy or quick revision.

SUMMARY OF THE INVENTION

This invention relates to a yardage marker system for use with sprinklers for indicating yardage from a sprinkler to a point of reference. The system includes a plurality of sprinklers each having an external surface which is visible from above by looking downwardly at the sprinkler. Means is provided for indicating on the sprinklers yardage markers having up to three digits with each yardage marker being built from a set of individual marker numbers having a single digit thereon selected from the range 0–9 with three separate marker numbers being individually applied in a desired sequence to the external surface of the sprinkler to form a three digit yardage marker or at least two separate marker numbers being individually applied in a desired sequence to the external surface of the sprinkler to form a two digit yardage marker.

BRIEF DESCRIPTION OF THE DRAWINGS

This invention will be described more completely hereafter in the Detailed Description, when taken in conjunction with the following drawings, in which like reference numerals refer to like elements throughout.

DETAILED DESCRIPTION

Figure 1:
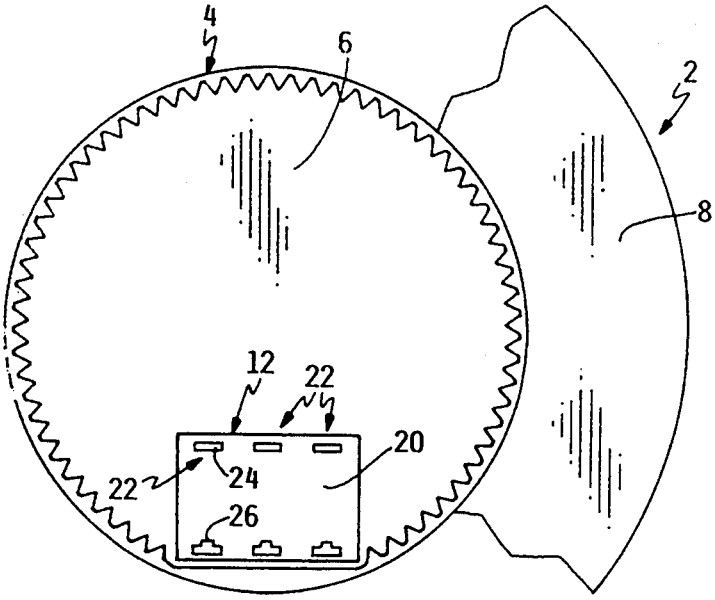
FIG. 1 is a partial, top plan view of a sprinkler having the yardage marker system of this invention, particularly illustrating the display area provided on the sprinkler for receiving and holding various individual numbers that collectively form a yardage marker without any such numbers having been installed in the display area in FIG. 1.

Referring first to FIG. 1, a generally conventional sprinkler 2 of the type to which the present invention relates is shown in FIG. 1. Sprinkler 2 is a pop-up sprinkler of the type which is suited to be buried in the ground so as to be unobtrusive. When water under pressure is applied to sprinkler 2, a central riser 4 of sprinkler 2 pops up out of the buried housing or body of sprinkler 2 to be elevated above the ground. Riser 4 carries one or more nozzles for spraying streams of water and may be rotatably driven about a vertical axis of rotation to spray water in a circle or a portion of a circle. If desired, sprinkler 2 could even be built to spray water in non-circular patterns.

Figure 2:
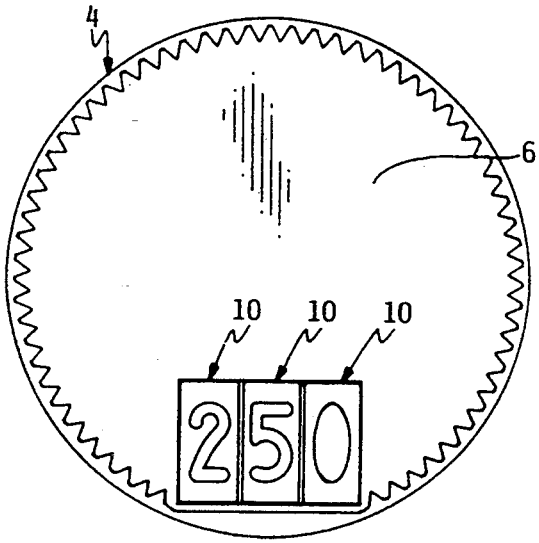
FIG. 2 is a top plan view similar to FIG. 1 of the sprinkler shown in FIG. 1, particularly illustrating various individual numbers having been installed in the display area on the sprinkler to indicate a first yardage value.
Figure 3:
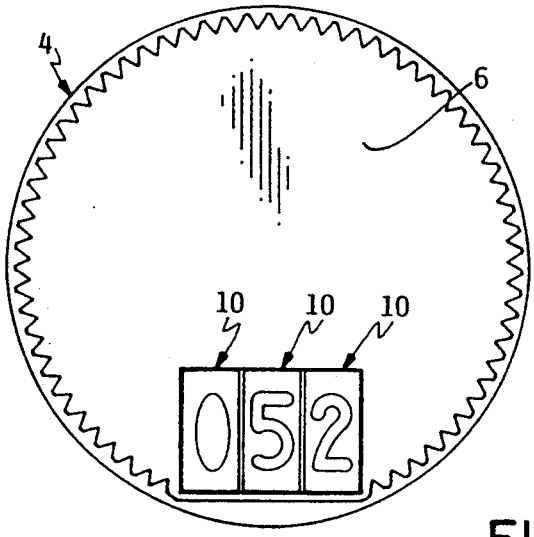
FIG. 3 is a top plan view similar to FIGS. 1 and 2 of the sprinkler shown in FIG. 1, particularly illustrating the individual numbers used in FIG. 2 having been removed from, rearranged, and then reinstalled in the display area on the sprinkler to indicate a second yardage value different from the first yardage value.

Only the top surface 6 of riser 4 is shown in the drawings. A circular, horizontal flange 8 provided at the top of the sprinkler body normally surrounds riser 4 and engages against the ground to prevent grass and weeds from growing up around riser 4 to insure that riser 4 can pop up out of the sprinkler housing. Only a small portion of flange 8 is shown in FIG. 1, it being understood that flange 8 completely surrounds riser 4 such that riser 4 pops up out of a central opening provided in flange 8. FIGS. 1–3 illustrate riser 4 from directly above the riser assuming one is looking downwardly at the riser.

On any typical golf course having an irrigation system, many sprinklers 2 will be spread throughout the course to irrigate the fairways and other relevant portions of the course. Thus, each hole will have many sprinklers 2 arranged along the length of the fairway from the tee box to the green. Accordingly, sprinkler 2 as depicted herein is preferably a sprinkler of the type normally used to irrigate golf courses, such as the models 730, 750, 760 and 780 sprinklers manufactured and sold by The Toro Company, the assignee of this invention.

This invention relates to an improved yardage marker system for easily indicating yardage on the top of sprinkler 2 at some location on the sprinkler which is visible when one looks down on the sprinkler. The yardage markers provided by the system of this invention can be easily and quickly revised should the yardage distances change for some reason. In addition, the yardage distances can be marked on sprinklers 2 immediately at the time that the survey of the yardage distances is made, without having to come back later to apply the yardage markers.

The yardage marker system of this invention allows yardage markers having up to three digits, e.g. 250 yards, to be constructed or built from a set of individual single digit numbers 10, i.e. the individual numbers 0–9, applied to the sprinkler head. The individual marker numbers 10 are physically separate from one another, and can be received and displayed on sprinkler head 2 in a side-by-side manner such that up to three individual numbers 10 collectively form the overall yardage marker. Preferably, the sprinkler head includes a display area 12 on a top surface thereof, preferably on top surface 6 of riser 4, for receiving and holding the individual marker numbers 10 so that the yardage marker is visible at all times when one looks down at sprinkler 2, even when riser 4 is retracted. This display area 12 includes means for allowing the individual marker numbers 10 to be pushed into sprinkler 2 and retained therein.

Figure 4:
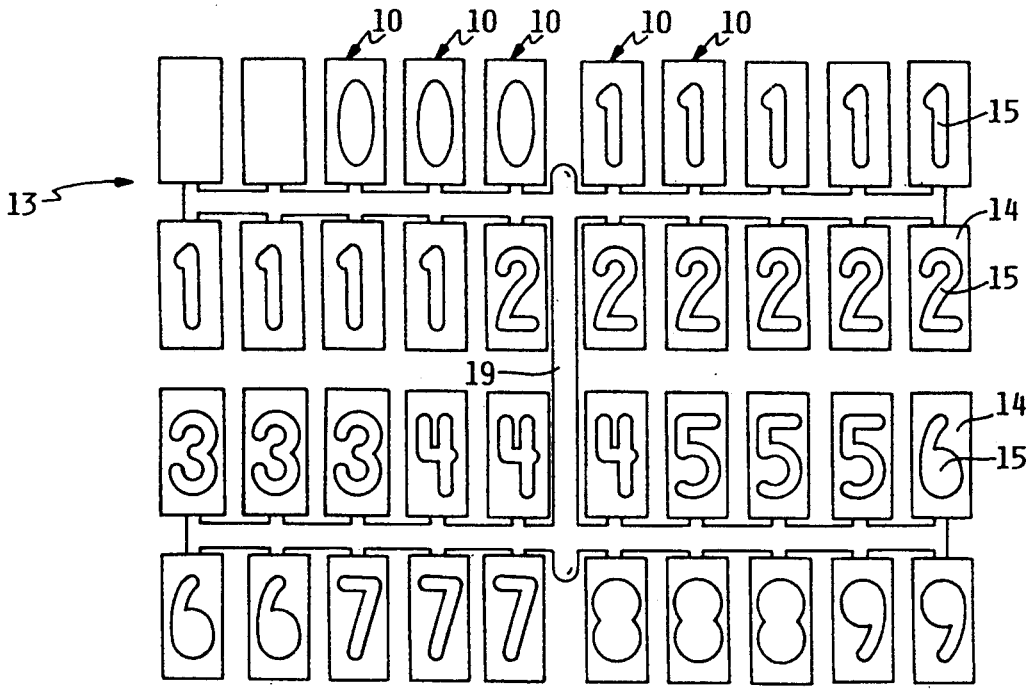
FIG. 4 is a top plan view of an array of individual numbers that form a portion of the yardage marker system of this invention.
Figure 5:
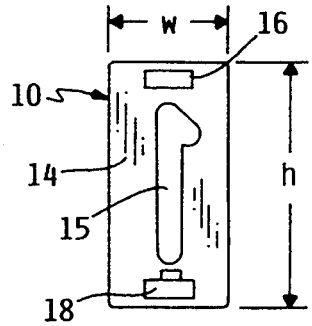
FIG. 5 is a bottom plan view of one particular individual number that forms a portion of the yardage marker system of this invention, particularly illustrating the attachment tabs for allowing the number to be received and held in the display area therefor on the sprinkler.
Figure 6:
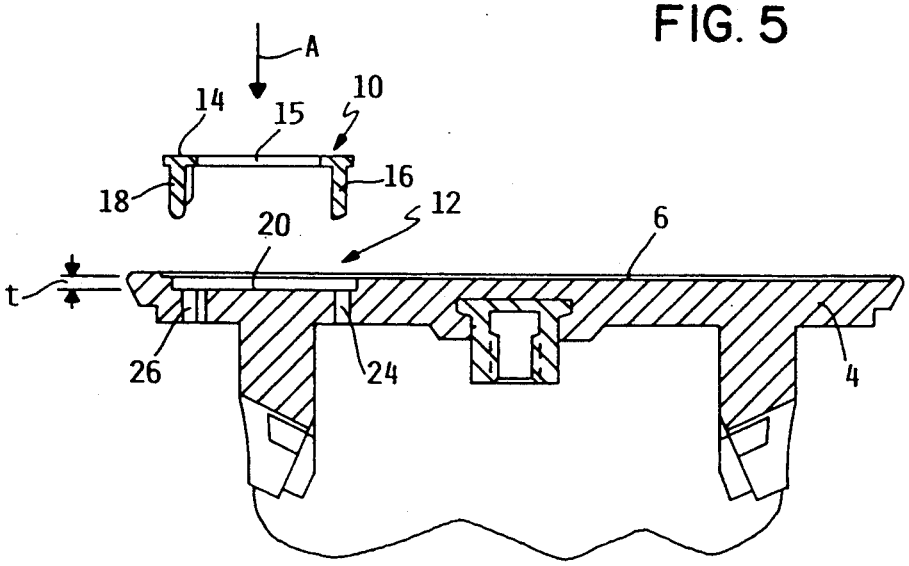
FIG. 6 is a cross-sectional view of the cap of the sprinkler shown in FIG. 1, particularly illustrating one number aligned with and spaced above the display area on the sprinkler prior to insertion of the number into the display area.

Referring now to FIGS. 4 and 5, the individual marker numbers 10 comprise a set 13 of individual single digit numbers having values from 0 to 9. Each number 10 includes a generally planar, rectangular plate 14 having one of the digits from 0 to 9, the digit being referred to as 15 in FIGS. 4–6 placed in the middle thereof. The plate 14 has a predetermined height h and predetermined width w. The back side of each plate is provided with two rearwardly projecting attachment tabs, an upper rectangular tab 16 and a lower T-shaped tab 18. Tabs 16 and 18 help align number 10 in display area 12 and help retain number 10 in place therein.

The numerical digits 15 from 0 to 9 preferably comprise open or relieved portions of plate 14 which extend all the way through the thickness of plate 14 so that the underlying surface of display area 12 will show through, though digits 15 could be painted or raised digits formed on plate 14 if desired. As most sprinkler bodies are normally formed of a black plastic material, plates 14 of numbers 10 are desirably provided in some light and eye catching color, such as white or yellow. Thus, when numbers 10 are placed on top of sprinkler 2, the contrasting black of the sprinkler body will show through the removed area forming the digit 15 such that the digit 15 is easily readable, appearing as a black number against a light background.

Preferably, numbers 10 are molded from plastic and may be provided in sets 13 contained on a tree 19. Whatever numbers 10 are required may be broken off the tree and used to form each yardage marker. Desirably, the sets 13 of numbers 10 that are provided will have more of the most often used digits 15 and less of the least often used digits 15. For example, the set 13 of numbers 10 illustrated in FIG. 4 has more of the number "1" digits and less of the number "9" digits. If desired, a few of the numbers 10 could be left entirely blank without any digits 15 formed therein, as shown by the first few marker numbers 10 on tree 19.

The display area 12 includes a rectangular display section 20 on top surface 6 which is set aside or reserved for the purpose of displaying a yardage marker. Display section 20 is slightly recessed relative to the top surface 6 by approximately the thickness of the marker plates 14 so that the marker numbers 10 when received in display section 20 will be generally flush with top surface 6. See the depth t of display section 20 in FIG. 6. Display section 20 is sufficiently high to be slightly greater than the height h of each marker plate 14, but is sufficiently wide to allow three marker numbers 10 to be set side-by-side therein to form a yardage marker having three digits capable of displaying yardages from 0 to 999 yards. As a practical matter, distances in excess of about 300 yards will not normally be shown due to the nature of golf and the ability of golfers to drive balls further than that.

Display section 20 includes three sets 22 of transversely spaced slots or apertures designed for holding up to three marker numbers 10 in a side-by-side orientation. Each set 22 of apertures comprises a top, rectangular aperture 24 and a bottom T-shaped aperture 26. Apertures 24 and 26 are shaped to mate with attachment tabs 16 and 18 on marker numbers 10. In addition, apertures 24 and 26 extend down through the top surface 6 of riser 4 sufficiently to allow the attachment tabs 16 and 18 to be press fit down into apertures 24 and 26, thereby to allow marker numbers 10 to, in effect, simply be pushed into place as indicated by the arrow A in FIG. 6 and once received on sprinkler 2 to be held in place therein. The use of T-shaped tab 18 and T-shaped aperture 26 insure that marker numbers 10 can be inserted in the proper orientation with the digits 15 being placed right side up and not being inverted.

The press fit between apertures 24 and 26 and tabs 16 and 18 is sufficient to hold marker numbers 10 in place, but the fit is not so tight that marker numbers 10 cannot be removed and replaced if desired. Removal is allowed simply by gripping numbers 10 and pulling up on them, or by using a tool such as a screwdriver to cam numbers 10 up slightly to allow them to be better gripped for removal. If desired, detents could be used between tabs 16 and 18 and apertures 24 and 26 to further help retain numbers in place during use.

The tab and aperture connection between numbers 10 and sprinkler 2 is preferred because tabs 16 and 18 and apertures 24 and 26 can be molded as part of the sprinkler and the numbers when these parts are themselves formed. However, other ways of releasably securing numbers 10 to sprinkler 2 to retain them in place could be used. For example, display section 20 could be provided with an upwardly facing strip of Velcro type material and the undersides of numbers 10 could be provided with mating strips of this material to allow a Velcro type connection to be made between each number 10 and sprinkler 2. Accordingly, this invention is not limited for use with a particular type of number securing means.

The use of the yardage marker system according to this invention should be apparent. It assumes that the golf course is provided with at least some sprinklers 2 having the necessary display means 10 for receiving and holding the yardage marker numbers. These sprinklers 2 will normally be spread out along the length of the fairways.

To mark sprinklers 2 with appropriate yardage markers, a survey will be done of the course with the yardage from each sprinkler 2 that one wishes to mark being determined by the surveyor. Assume for the moment that the distance of a particular sprinkler has just been determined by the surveyor to be 250 yards from the reference point on the green that is being used, e.g. the front edge, the center, the back edge, etc. The yardage marker can then be immediately installed at the time of the survey simply by breaking off three numbers 10 from tree 19 having the digits "2", "5", and "0" and by pushing these numbers 10 into place in display section 20 in a side-by-side orientation to form the three digit yardage marker "250". See the representation of this yardage marker in FIG. 2.

This survey and marking process is repeated for all the remaining sprinklers 2 that one desires to mark on the golf course. The distance from each sprinkler to the reference point on the green is determined, and then the required numbers 10 having the appropriate digits 15 that spell out the entire three digit yardage value are used to form the yardage marker. Again, each yardage marker can easily and quickly be applied to each sprinkler at the time the survey is made.

To indicate distances of less than 100 yards, the first leading number 10 is not strictly required, and could be deleted entirely, with only two numbers 10 being used in the middle and trailing spots in display section 20. However, since this leaves one set 22 of apertures 24 and 26 exposed, it is preferred that this leading space be filled, such as by the number 10 having the digit "0". Such a representation is shown in FIG. 3 with the yardage marker "052" representing a distance of 52 yards. However, the leading space could also be filled with the blank number 10 provided at the beginning of the number set 13 as shown in FIG. 4. In this event, the yardage marker would comprise sequentially the number 10 having a solid or blank plate 14 followed by two numbers 10 having the digits "5" and "2". This would still mean and be read as 52 yards. Thus, the blank number 10 and the number 10 having the digit "0" are equivalent to one another and may be used alternatively for one another with respect to the leading space of a three digit yardage marker when forming a yardage marker indicating a distance less than 100 yards.

The yardage marker system of this invention has many advantages over prior art systems. It can be used at the time the distance survey of the golf course is done to mark the yardage distances at that time, without having to have custom made plates manufactured and to have these plates later attached to the sprinklers. In addition, the individual marker numbers 10 can be quickly and easily applied to sprinkler 2, and held therein, simply by pushing numbers 10 into sprinkler 2, specifically into top surface 6 of riser 4. While display area 12 has been provided on riser 4, it could have been provided on any other external surface of sprinkler 2 that is visible from above, such as on flange 8. However, it is preferred that the yardage markers be applied to riser 4 as opposed to flange 8.

Another advantage is the ease of readjusting the yardage markers should the distances change because the golf course is remodeled. All that needs to be done is to do a new survey after the remodeling is finished to determine the new distances, and to rearrange the individual numbers 10 forming the yardage markers (or use new numbers 10) as may be needed to reflect the changed distances. For example, looking at FIGS. 2 and 3, assume that a particular sprinkler head 2 has a distance to the green of 250 yards before the remodeling, but is only 52 yards from the green after the remodeling. This new distance can be indicated on the sprinkler simply by removing and transposing the numbers 10 having the digits "2" and "0" as shown in FIG. 2, the leading digit "2" in FIG. 2 being moved to the trailing spot in FIG. 3 and the trailing digit "0" in FIG. 2 being moved to the leading spot in FIG. 3. If the new distance needed some numbers 10 having digits other than "2" "5" and "0", then other numbers 10 off of tree 19 would be used as required and the original numbers 10 having the unneeded digits would be retained for use in marking some other sprinklers 2.

Various modifications of this invention will be apparent to those skilled in the art. Thus, the scope of the invention is to be limited only by the appended claims.

We claim:

1. A yardage marker system for use with sprinklers for indicating yardage from a sprinkler to a point of reference, which comprises:

a plurality of sprinklers each having an external surface which is visible from above by looking downwardly at the sprinkler; and means for indicating on the sprinklers yardage markers having up to three digits with each yardage marker being built from a set of individual marker numbers having a single digit thereon selected from the range 0–9 with at least two separate marker numbers being individually applied in a desired sequence to the external surface of the sprinkler to form at least a two digit yardage marker.

2. A yardage marker system as recited in claim 1, wherein the external surface of the sprinklers includes a display area for receiving the marker numbers.

3. A yardage marker system as recited in claim 2, wherein the sprinkler includes a pop-up riser having a top surface that forms a portion of the external surface of the sprinkler, and wherein the display area is provided on the top surface of the pop-up riser.

4. A yardage marker system as recited in claim 2, further including cooperable means provided on the display area of the sprinkler and on the marker numbers for allowing the marker numbers to be pushed into the display area and retained therein.

5. A yardage marker system as recited in claim 2, wherein each marker number comprises a marker plate having the digit formed therein by a relieved portion of the plate which extends completely through the plate, and wherein the marker plates are formed of a contrasting color from a color used to form the display area of the sprinkler such that the display area of the sprinkler shows through the relieved digit forming portions of the marker plate to form the digit when the marker plates are inserted in the display area.

6. A yardage marker system for use with sprinklers for indicating yardage from a sprinkler to a point of reference, which comprises:

a plurality of sprinklers each having an external surface which is visible from above by looking downwardly at the sprinkler; and means for indicating on the sprinklers yardage markers having up to three digits with each yardage marker being built from a set of individual marker number having a single digit thereon selected from the range 0–9 with at least two separate marker numbers being individually applied in a desired sequence to the external surface of the sprinkler to form at least a two digit yardage marker, wherein the set of marker numbers includes blank marker numbers having no numeric digits thereon, such blank marker numbers being usable as a leading marker number when three marker numbers are used to indicate yardage distances of less than 100 yards.

7. A yardage marker system for use with sprinklers for indicating yardage from a sprinkler to a point of reference, which comprises:

a plurality of sprinklers each having an external surface which is visible from above by looking downwardly at the sprinkler; and means for indicating on the sprinklers yardage markers having up to three digits with each yardage marker being built from a set of individual marker numbers having a single digit thereon selected from the range 0–9 with at least two separate marker numbers being individually applied in a desired sequence to the external surface of the sprinkler to form at least a two digit yardage marker, wherein the external surface of the sprinklers includes a display area for receiving the marker numbers, wherein the marker numbers have a predetermined thickness, and wherein the display area is recessed below the external surface of the sprinklers by approximately the thickness of the marker numbers such that the marker numbers are flush with the external surface when received in the display area.

8. A yardage marker system as recited in claim 7, wherein each marker number includes a generally rectangular marker plate having a predetermined height and width, and wherein the display area is generally rectangular having a display area height which is slightly greater than the height of a marker plate and a display area width which is slightly greater than the combined widths of three marker plates set side-by-side, whereby up to three marker plates may be arranged side-by-side in the recessed display area.

9. A yardage marker system for use with sprinklers for indicating yardage from a sprinkler to a point of reference, which comprises:

a plurality of sprinklers each having an external surface which is visible from above by looking downwardly at the sprinkler; and means for indicating on the sprinklers yardage markers having up to three digits with each yardage marker being built from a set of individual marker numbers having a single digit thereon selected from the range 0–9 with at least two separate marker numbers being individually applied in a desired sequence to the external surface of the sprinkler to form at least a two digit yardage marker, wherein the external surface of the sprinklers includes a display area for receiving the marker numbers, and further including cooperable means provided on the display area of the sprinkler and on the marker numbers for allowing the marker numbers to be pushed into the display area and retained therein, wherein the cooperable means comprises a tab and slot connection between the marker numbers and the display area of the sprinkler.

10. A yardage marker system as recited in claim 9, wherein each marker number has at least one vertically protruding tab extending from an underside thereof, and the display area has at least one slot provided therein for each marker number received in the display area which slot has a depth which is sufficient to receive the tab when the marker numbers are pushed into place in the display area.

11. A yardage marker system for use with sprinklers for indicating yardage from a sprinkler to a point of reference, which comprises:

a plurality of sprinklers each having an external surface which is visible from above by looking downwardly at the sprinkler; and means for indicating on the sprinklers yardage markers having up to three digits with each yardage marker being built from a set of individual marker numbers having a single digit thereon selected from the range 0–9 with at least two separate marker numbers being individually applied in a desired sequence to the external surface of the sprinkler to form at least a two digit yardage marker, wherein the external surface of the sprinklers includes a display area for receiving the marker numbers; and cooperable means provided on the display area of the sprinkler and on the marker numbers for allowing the marker numbers to be pushed into the display area and retained therein, wherein the cooperable means comprises a tab and slot connection between the marker numbers and the display area of the sprinkler, and wherein each marker number has two vertically protruding tabs extending from an underside thereof which are shaped differently from one another, and the display area has two slots provided therein for each marker number to be received in the display area which slots are differently shaped respectively to receive the two differently shaped tabs on the marker number and which slots have a depth which is sufficient to receive the tabs, to thereby insure that the marker numbers are insertable into the display area right side up only.

12. A yardage marker system as recited in claim 11, wherein each marker number comprises a marker plate having the digit formed therein by a relieved portion of the plate which extends completely through the plate, and wherein the marker plates are formed of a contrasting color from a color used to form the display area of the sprinkler such that the display area of the sprinkler shows through the relieved digit forming portions of the marker plate to form the digit when the marker plates are inserted in the display area.

13. A yardage marker system for use with sprinklers for indicating yardage from a sprinkler to a point of reference, wherein the sprinklers each have an external surface which is visible from above by looking downwardly at the sprinkler when the sprinkler is installed in the ground, which comprises:

a set of individual marker numbers that are physically separate from one another when in use with each marker number having a single digit thereon selected from the range 0–9, wherein a plurality of marker numbers are provided for each digit in the range 0–9 such that a plurality of marker numbers with the number 0, a plurality of marker numbers with the number 1, and so on up to a plurality of marker numbers with the number 9 are available for marking purposes; and display means on the external surfaces of the sprinklers for allowing a plurality of marker numbers to be pushed into place on the external surfaces of the sprinklers and retained thereon in a side-by-side manner to form yardage markers having multiple digits, the marker numbers being placed in a desired numeric sequence to form the desired yardage marker.

14. A yardage marker system as recited in claim 13, wherein the display means is configured to receive and hold up to three marker numbers side-by-side.

15. A yardage marker system for use with sprinklers for indicating yardage from a sprinkler to a point of reference, wherein the sprinklers each have an external surface which is visible from above by looking downwardly at the sprinkler when the sprinkler is installed in the ground, which comprises:

a set of individual marker numbers that are physically separate from one another when in use with each marker number having a single digit thereon selected from the range 0–9, wherein a plurality of marker numbers are provided for each digit in the range 0–9 such that a plurality of marker numbers with the number 0, a plurality of marker numbers with the number 1, and so on up to a plurality of marker numbers with the number 9 are available for marking purposes; and display means on the external surfaces of the sprinklers for allowing, a plurality of marker numbers to be pushed into place on the external surfaces of the sprinklers and retained thereon in a side-by-side manner to form yardage markers having multiple digits, the marker numbers being placed in a desired numeric sequence to form the desired yardage marker, wherein the marker numbers have a predetermined thickness, and wherein the display means is recessed below the external surface of each sprinkler by approximately the thickness of the marker numbers such that the marker numbers are flush with the external surface of each sprinkler when received in the display means.

16. A yardage marker system for use with sprinklers for indicating yardage from a sprinkler to a point of reference, wherein the sprinklers each have an external surface which is visible from above by looking downwardly at the sprinkler when the sprinkler is installed in the ground, which comprises:

a set of individual marker numbers that are physically separate from one another when in use with each marker number having a single digit thereon selected from the range 0–9, wherein a plurality of marker numbers are provided for each digit in the range 0–9 such that a plurality of marker numbers with the number 0, a plurality of marker numbers with the number 1, and so on up to a plurality of marker numbers with the number 9 are available for marking purposes; and display means on the external surfaces of the sprinklers for allowing a plurality of marker numbers to be pushed into place on the external surfaces of the sprinklers and retained thereon in a side-by-side inner to form yardage markers having multiple digits, the marker numbers being placed in a desired bumeric sequence to form the desired yardage marker, and further including a tab and slot connection between the marker numbers and the display means of the sprinkler for allowing the marker numbers to be pushed into the display means and retained therein.

17. A yardage marker system for use with sprinklers for indicating yardage from a sprinkler to a point of reference, wherein the sprinklers each have an external surface which is visible from above by looking downwardly at the sprinkler when the sprinkler is installed in the ground, which comprises:

a set of individual marker numbers that are physically separate from one another when in use with each marker number having a single digit thereon selected from the range 0–9, wherein a plurality of marker numbers are provided for each digit in the range 0–9 such that a plurality of marker numbers with the number 0, a plurality of marker numbers with the number 1, and so on up to a plurality of marker numbers with the number 9 are available for marking purposes; and display means on the external surfaces of the sprinklers for allowing a plurality of marker numbers to be pushed into place on the external surfaces of the sprinklers and retained thereon in a side-by-side manner to form yardage markers having multiple digits, the marker numbers being placed in a desired numeric sequence to form the desired yardage marker, further including connection means between the marker numbers and the display means of the sprinkler for allowing the marker numbers to be placed into the display means and retained therein, wherein the connection means has means for allowing the marker numbers to be received in the display means right side up only.

18. A method of providing yardage markers on sprinklers on a golf course having multiple irrigation sprinklers placed thereon, the yardage markers being used to indicate a yardage distance from the marked sprinkler to a point of reference, which comprises:

providing a set of individual marker numbers that are physically separate from one another when in use with each marker number having a single digit thereon selected from the range 0–9, wherein a plurality of marker numbers are provided for each digit in the range 0–9 such that a plurality of marker numbers with the number 0, a plurality of marker numbers with the number 1, and so on up to a plurality of marker numbers with the number 9 are available for marking purposes; and marking selected sprinklers with the yardage distance of each selected sprinkler to the point of reference by applying in a side-by-side manner to the external surface of each selected sprinkler those individual marker numbers that sequentially form the yardage distance of that selected sprinkler to the point of reference.

19. A method as recited in claim 18, which further comprises:

conducting a survey of the selected sprinklers to be marked to determine the distance from each selected sprinkler to the point of reference; and marking each selected sprinkler substantially immediately after the survey of that selected sprinkler is made.

20. A method as recited in claim 18, which further comprises:

providing yardage markers having three digits by sequentially applying in a side-by-side manner three individual marker numbers in the appropriate sequence to the sprinklers; and providing yarding markers having two digits by sequentially applying in a side-by-side manner at least two individual marker numbers in the appropriate sequence to the sprinklers.

21. A method of providing yardage markers on sprinklers on a golf course having multiple irrigation sprinklers placed thereon, the yardage markers being used to indicate a yardage distance from the marked sprinkler to a point of reference, which comprises:

providing a set of individual marker numbers that are physically separate from one another when in use with each marker number having a single digit thereon selected from the range 0–9, wherein a plurality of marker numbers are provided for each digit in the range 0–9 such that a plurality of marker numbers with the number 0, a plurality of marker numbers with the number 1, and so on up to a plurality of marker numbers with the number 9 are available for marking purposes;

providing some blank marker numbers having no numeric digits thereon;

marking selected sprinklers with the yardage distance of each selected sprinkler to the point of reference by applying in a side-by-side manner to the external surface of each selected sprinkler those individual marker numbers that sequentially form the yardage distance of that selected sprinkler to the point of reference wherein the marking step further comprises:

providing yardage markers having three digits by sequentially applying in a side-by-side manner three individual marker numbers in the appropriate sequence to the sprinklers; and providing yardage markers having two digits by sequentially applying in a side-by-side manner three marker numbers with the leading marker number comprising the blank marker number and the remaining marker numbers being applied in the appropriate sequence to the sprinklers.

* * * * *